US005612534A

United States Patent [19]

Mimura et al.

[11] Patent Number: 5,612,534

[45] Date of Patent: Mar. 18, 1997

[54] ATMOSPHERIC PRESSURE IONIZATION MASS SPECTROMETER

[75] Inventors: Tadao Mimura; Masayoshi Yano, both of Katsuta, Japan

[73] Assignee: Hitachi, Ltd., Tokyo, Japan

[21] Appl. No.: 689,952

[22] Filed: Aug. 16, 1996

Related U.S. Application Data

[63] Continuation of Ser. No. 325,098, Nov. 2, 1994, abandoned.

[30] Foreign Application Priority Data

Nov. 9, 1993 [JP] Japan ..... 5-279310

[51] Int. Cl.[6] ..... H01J 49/04

[52] U.S. Cl. ..... 250/281; 250/288

[58] Field of Search ..... 250/281, 288, 250/423 R

[56] References Cited

U.S. PATENT DOCUMENTS

| | | | |
|---|---|---|---|
| 4,485,822 | 12/1984 | O'Connor et al. | 128/719 |
| 4,769,540 | 9/1988 | Mitsui et al. | 250/288 |
| 4,820,920 | 4/1989 | Bather | 250/288 |
| 4,861,988 | 8/1989 | Henion et al. | 290/288 |
| 4,960,467 | 10/1990 | Peck | 106/209 |

FOREIGN PATENT DOCUMENTS

| | | |
|---|---|---|
| 60-127453 | 7/1985 | Japan . |
| 61-54144 | 3/1986 | Japan . |
| 62-103954 | 5/1987 | Japan . |
| 3-296659 | 12/1991 | Japan . |
| 4-353761 | 12/1992 | Japan . |

OTHER PUBLICATIONS

Analytical Chemistry, vol. 62, No. 13, Jul. 1, 1990, Eric C. Huang et al.: *Atmospheric Pressure Ionization Mass Spectrometry, Detection for the Separation Sciences.*

*Primary Examiner*—Jack I. Berman
*Attorney, Agent, or Firm*—Kenyon & Kenyon

[57] ABSTRACT

An atmospheric pressure ionization spectrometer capable for continuously detecting impurities included in air or gas can be realized. The air or gas is stored in a daily storage such as a bag, a package, a pocket or the like. An air suction probe is connected to an ion source through an insulation pipe, and the ion source is connected to an air exhaust pump through an exhaust port and an insulation pipe. The ion source has a needle electrode, a first small hole electrode, an intermediate pressure portion and a second small hole electrode, and the needle electrode is connected to a power source, and the first and second small hole electrodes are connected to an ion accelerating power source. The intermediate pressure portion is connected to a vacuum pump through the exhaust port. An electrostatic lens is disposed in the stage following the intermediate pressure portion, and a mass spectrometric portion and a detector are disposed in the stage following the electrostatic lens. A detection signal from the detector is supplied to a data processing portion through an amplifier. The data processing portion determines a plurality of M/Z values indicating a special drug to thereby determine whether or not the special drug is included in the sample gas.

17 Claims, 8 Drawing Sheets

ATMOSPHERIC PRESSURE IONIZATION MASS SPECTROMETER

This is a continuation of U.S. patent application Ser. No. 08/325,098, filed Nov. 2, 1994 and now abandoned.

BACKGROUND OF THE INVENTION

The present invention relates to an atmospheric pressure ionization mass spectrometer, and particularly to an atmospheric pressure ionization mass spectrometer having an ionization function using molecular reaction such as atmospheric pressure ionization, chemical ionization or the like.

There is known an atmospheric pressure ionization mass spectrometer which has an ion source operating under atmospheric pressure so as to analyze sample gas (for example, as disclosed in JP-A 60-127453, JP-A 61-54144, JP-A 62-103954, JP-A 3-296659, and JP-A 4-353761).

FIG. 6 is a schematic view showing the configuration of such an atmospheric pressure ionization mass spectrometer. This atmospheric pressure ionization mass spectrometer is an apparatus for performing qualitative or quantitative analysis of NO, $O_2$ and so on included in nitrogen gas, and, particularly, an apparatus for making measurement as to how much impure gas such as NO gas, $O_2$ gas and so on is mixed into nitrogen in the process of producing nitrogen gas.

In FIG. 6, $N_2$ gas, which is sample gas to be measured, is fed to a valve 2 through a stainless steel pipe 3 from a $N_2$ gas cylinder 1. The $N_2$ gas is introduced to an API (Atmospheric Pressure Ionization) ion source 4 through the valve 2. The $N_2$ gas introduced into the API ion source 4 is ionized by corona discharge generated from the top end of a needle electrode 5. The ionized $N_2$ gas reacts with impure gas such as NO, $O_2$ and so on included in the $N_2$ gas to thereby ionize the NO and $O_2$ gases. This is because the ionization potential of the $N_2$ gas is higher than that of the NO and $O_2$ gases. The thus ionized $N_2$ ions extract electrons from the NO and $O_2$ gases when the $N_2$ ions collide against the NO and $O_2$ gases having lower ionization potential, thereby ionize the NO and $O_2$ gases. Ions of the ionized NO and $O_2$ gases are passed through a first small hole electrode 6, an intermediate pressure portion 7 and a second small hole electrode 8, then focused by an electrostatic lens 9, and thereafter supplied, as an ion beam, to a mass spectrometric portion 10. In the mass spectrometric portion 10, the ion beam is dispersed in accordance with mass so that NO ions and $O_2$ ions are detected as mass spectra of the mass numbers 30 and 32 respectively.

On the other hand, in the case of quantitative measurement, $N_2$ gas having a known NO content, for example, is introduced into the API ion source 4 as standard gas from a standard gas cylinder 12 through a valve 11. Normally, this standard gas contains NO by about 100 ppm in $N_2$ gas. The standard gas is mixed with sample gas passed through the valve 2 immediately before it is introduced into the API ion source 4, and the mixture is introduced into the API ion source 4 to thereby be ionized by corona discharge in the same manner as mentioned above.

Each of the valves 2 and 11 has a mass flow controller 26 as shown in FIG. 7. In the mass flow controller 26, a gas flow passage is branched into two portions where a bypass 261 and a sensor 262 are disposed respectively. The sensor 262 has two self-heating resistors wound on a capillary tube, and the two resistors are connected to a bridge circuit 263. A signal from the bridge circuit 263 is supplied to a correction circuit 265 through an amplifier circuit 264.

An output voltage signal from the correction circuit 265 is supplied to a comparator/controller circuit 27 and, at the same time, supplied to a control means (not-shown). The comparator/controller circuit 27 compares a setting voltage signal supplied from the control means with the output voltage signal from the correction circuit 265, and controls a control valve 28 so that there is no difference between both the setting voltage signal and the output voltage signal.

Here, assume that the sample gas is made to flow through the valve 2 at the flow rate Qx (liter/min), and at the same time, the standard gas is made to flow through the valve 11 at the flow rate Qs (liter/min), so that the sample and standard gases are mixed with each other. In this case, for example, supposing that the density of NO in the standard gas is Cs (ppm), then the additive density of NO becomes (Qs/Qx).Cs (ppm) according to primary approximation. The additive density is adjusted by changing the flow rate Qs of the standard gas.

The standard gas is added in a plurality of stages while the quantity of sample gas is kept constant. At that time, the additive density is plotted on the abscissa, and the ionic strength is plotted on the ordinate. Assuming that the ionic strength and the additive density have a linear relationship expressed by a line $y=ax+b$, then the ionic strength y when the additive density x is zero, that is, the value b represents the ionic density of NO included in the sample gas. Further, the value of x, that is, Xo, when the ionic strength is zero, designates the density of NO. FIG. 8 shows this relationship. That is, the density of NO in the sample gas is expressed by the following expression (1).

$$Xo=b/a \quad —(1)$$

The gas analysis with such an atmospheric pressure ionization mass spectrometer has the following features.

1. The number of times of collision of molecules or ions against with each other is large under atmospheric pressure. Accordingly, even a very small amount of impurities have many chances of collisions, and it is possible to perform high sensitive analysis.
2. Substances lower in ionization voltage are ionized mainly. Accordingly it is possible to perform selective ionization.

SUMMARY OF THE INVENTION

The atmospheric pressure ionization mass spectrometer can analyze a very small amount of impurities with a high sensitivity as mentioned above. Accordingly, it is advantageous if the mass spectrometer can be used for detecting impurities included in air or gas which is stored not in a special storage such as a cylinder or the like but in a daily storage such as a bag, a package, a pocket or the like. Particularly, it is advantageous if the main spectrometer can be used for detecting drugs brought in illegally.

However, the above-mentioned conventional atmospheric pressure ionization mass spectrometer was intended to perform quantitative measurement of a very small amount of impurities included in gas manufactured in a factory or the like, and it is therefore unsuitable for the detection of air or gas stored in such a daily storage as mentioned above.

That is, in the conventional atmospheric pressure ionization mass spectrometer, a mass flow controller is used so that sample gas to be measured is introduced into an ion source by means of the pressure of the sample gas charged into a cylinder. Therefore, to introduce air or gas stored in a daily storage such as a bag, a package, a pocket or the like into the ion source, the air or gas must be charged into a suitable cylinder. For this, it is not only necessary to provide a charger for charging air or gas into a cylinder, but also it takes much time to detect drugs or the like. Accordingly, the conventional atmospheric pressure ionization mass spectrometer can be employed particularly in the case that there are a plenty of objects to be measured, for example, and the case that the baggages or the like belonging to a large number of passengers who will get on planes are inspected.

In addition, for example, drugs such as narcotics which are brought into the country from foreign countries have not always been refined. That is, for example, it can be considered that drugs such as narcotics synthesized in foreign countries are brought into the country and thereafter refined. In this case, probably the number of kinds of synthesized drugs reach several scores. Therefore, even if gas in which several scores of these drugs are synthesized is analyzed by use of the conventional atmospheric pressure ionization mass spectrometer, it has been difficult to determine whether or not the gas includes the drugs to be detected.

It is therefore an object of the present invention to solve the foregoing problems.

It is another object of the present invention to realize an atmospheric pressure ionization mass spectrometer by which it is possible to continuously and easily detect impurities included in sample gas such as air or gas stored in a daily storage such as a bag, a package, a pocket or the like, and particularly drugs brought in illegally.

To attain the foregoing objects, the present invention provides an atmospheric pressure ionization mass spectrometer includes: an ionization portion which operates under atmospheric pressure or near the atmosphere pressure to ionize sample gas; a mass spectrometric portion to which ions produced in the ionization portion are supplied through an intermediate pressure region and which analyzes the ions; a sample gas suction unit which is movably disposed in a suction port of the ionization portion; and a drug determining portion for determining whether or not a predetermined drug is contained in a component analyzed by the mass spectrometric portion.

Preferably, in the atmospheric pressure ionization mass spectrometer, the sample gas suction unit is connected with the suction port of the ionization portion through a flexible first pipe, and wherein a capillary tube is mounted onto a sample gas suction portion of the sample gas suction unit.

Preferably, in the atmospheric pressure ionization mass spectrometer, an exhaust port is provided in the ionization portion, and an exhaust unit is connected to the exhaust port through a second pipe so as to exhaust internal gas in the ionization portion at a predetermined exhaust flow rate.

Preferably, in the atmospheric pressure ionization mass spectrometer, the drug determining portion determines whether or not a plurality of M/Z values indicating a predetermined drug exist in a mass spectrum analyzed and obtained by the mass spectrometric portion to thereby determine whether the predetermined drug is contained or not in the component analyzed by the mass spectrometric portion.

Preferably, in the atmospheric pressure ionization mass spectrometer, a filter for removing dusts is mounted on the sample gas suction unit, and sample gas sucked by the sample gas suction unit is supplied to the ionization portion through the filter.

Preferably, in the atmospheric pressure ionization mass spectrometer, the exhaust flow rate of the exhaust unit can be desirably set and wherein the exhaust unit can exhaust internal gas in the ionization portion while maintaining the exhaust flow rate setting.

Preferably, in the atmospheric pressure ionization mass spectrometer, each of the first and second pipes is formed of an insulating material.

From the sample gas introduced by the sample gas suction unit, dusts are removed through the filter attached to the sample gas suction unit. The sample gas, from which dusts are thus removed, is introduced into the ionization portion through the first insulation pipe. The reason why the sample gas is introduced into the ionization portion through the first insulation pipe is that a high voltage is being applied to the ionization portion. Ordinarily, a high voltage in a range of from several scores of volts to several kilo-volts is applied to the ionization portion as an ion accelerating voltage. Therefore, one can be prevented from suffering with an electric shock by the intervention of the first insulation pipe even if one touches the sample gas suction unit with one's bare hands. Most of the sample gas introduced into the ionization portion is discharged by means of the exhaust unit to the atmosphere from the exhaust port of the ionization portion through the second insulation pipe. The ionization portion and the exhaust unit are electrically insulated from each other by the second insulation pipe.

Molecules of drugs included in the sample gas introduced into the ionization portion are ionized by corona discharge. In this process of ionization, molecules of water contained in the sample gas are first ionized by corona discharge, and the ions of these water molecules collide with molecules of drugs included in the sample gas to thereby ionize the molecules of drugs. The molecule ions of the ionized drugs are introduced into the mass spectrometric portion. The drug determining section determines whether the component analyzed by the mass spectrometric portion is a predetermined drug or not.

DESCRIPTION OF THE PREFERRED EMBODIMENTS

Figure 1:
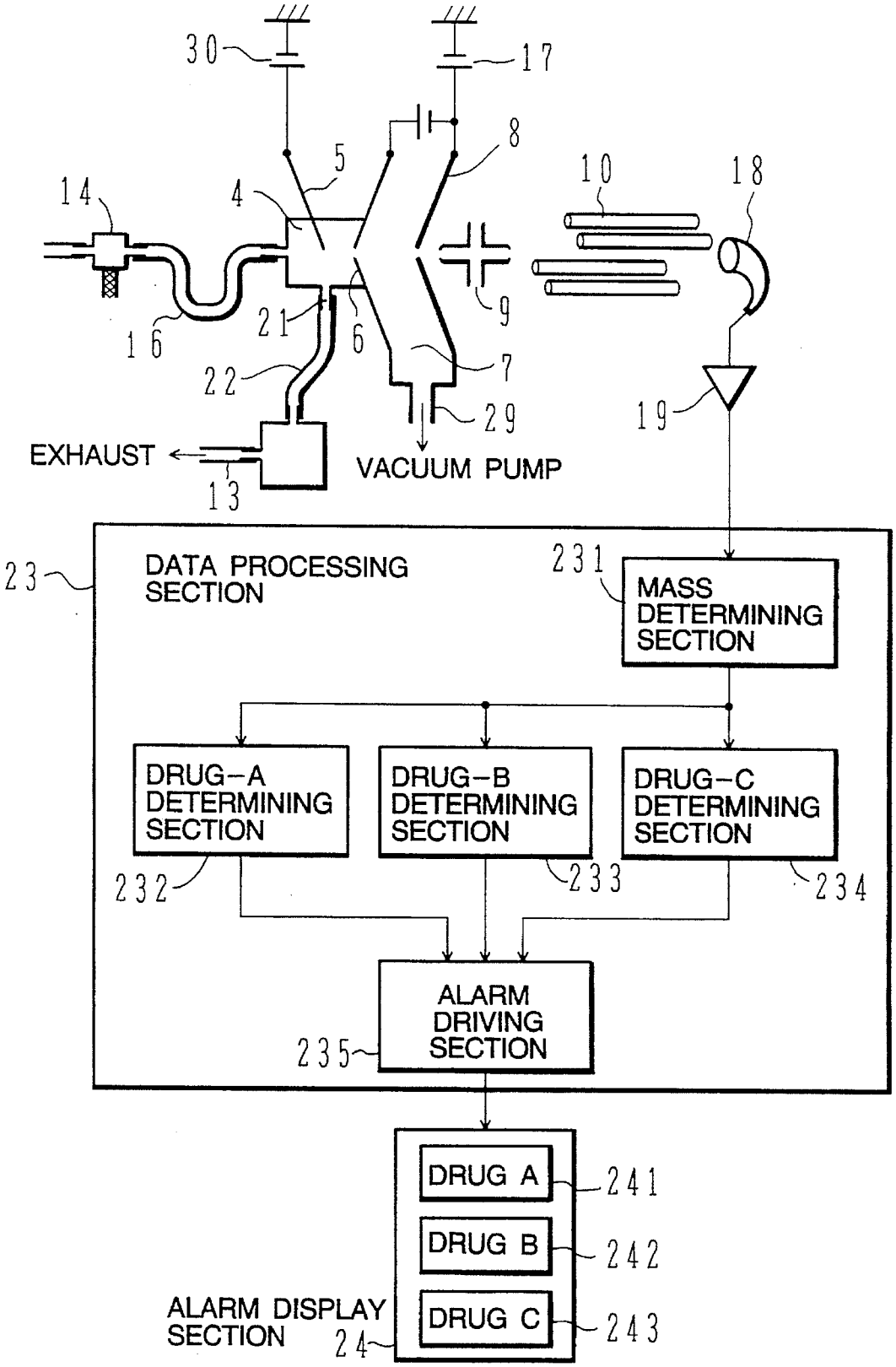
FIG. 1 is a schematic diagram illustrating the configuration of a first embodiment of the present invention.

An atmospheric pressure ionization mass spectrometer according to the present invention will be described with reference to the accompanying drawings. FIG. 1 shows a schematic configuration of an atmospheric pressure ionization mass spectrometer according to a first embodiment of the present invention. An air suction probe 14 is connected to an API ion source 4 through an insulation pipe 16. The ion source 4 is connected to an air exhaust pump 13 through an exhaust port 21 and an insulation pipe 22. The ion source 4 has a needle electrode 5, a first small hole electrode 6, an intermediate pressure portion 7 and a second small hole electrode 8. The needle electrode 5 is connected to a power source 30, and the first and second small hole electrodes 6 and 8 are connected to an ion accelerating power source 17. The intermediate pressure portion 7 is connected to a vacuum pump (not shown) through an exhaust port 29.

An electrostatic lens 9 is disposed in the stage succeeding the second small hole electrode 8, and a mass spectrometric portion 10 and a detector 18 are disposed in the stage succeeding the electrostatic lens 9. A detection signal from the detector 18 is supplied to a data processing section 23 through an amplifier 19. This data processing section 23 has a mass determining section 231, a drug A determining section 232, a drug B determining section 233, a drug C determining section 234 and an alarm driving section 235. Display portions 241 to 243 are disposed in an alarm display section 24 which is driven by the alarm driving section 235. Examples of the above-mentioned drugs A to C include a stimulant, a hemp and a narcotic.

Figure 2:
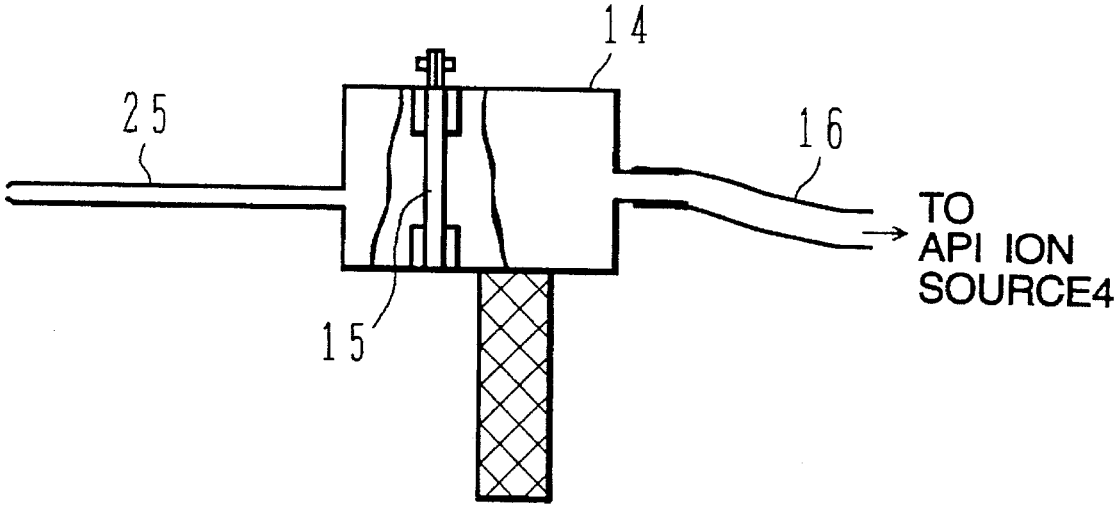
FIG. 2 is a partially broken sectional view illustrating a probe.

FIG. 2 is an enlarged and partially broken view showing the probe 14. Referring to FIG. 2, the probe 14 has a cylindrical suction portion 25. In addition, a filter 15 is mounted inside the probe 14. This filter 15 is provided to remove dusts included in the air introduced into the probe 14 through the suction portion 25 so as to prevent dusts and so on from being introduced into the ion source 4. Not only the ion source 4 is contaminated if dusts enter into the ion source 4, but also, if the entered dusts adhere to the needle electrode 5, the needle electrode 5 becomes impossible to generate corona discharge from its top end, so that the introduced air cannot be ionized.

Preferably the filter 15 is constituted by a stainless steel plate. To remove dusts, for example, inexpensive sponge or the like is ordinarily considered as the material of the filter 15. However, sponge contains a plasticizer, and this plasticizer is released as gas to thereby be mixed with the air introduced into the probe 14. As a consequence, the released gas appears in M/Z 218 of the mass spectrum as a background noise, for example. Accordingly, a material which does not produce gas is preferable as the filter 15. In the example of FIG. 2, a stainless steel plate is used as the filter that has holes of a diameter in a range of from several scores of microns to several hundred microns.

The probe 14 and the API ion source 4 are connected through the insulation pipe 16 so that the probe 14 and the API ion source 4 are insulated from each other. A voltage in a range of from several scores of volts to several kilo-volts is ordinarily applied to the ion source 4 from the ion accelerating power source 17. Therefore, insulation is required for preventing a user from suffering with an electrical shock when the user moves the probe 14 to a desirable measurement place easily with the user's bare hands. Preferably, the insulation pipe 16 is soft and thin enough to allow the probe 14 to move desirably. In the example of FIG. 2, a Teflon pipe is used as the insulation pipe 16.

In FIG. 1, when the air exhaust pump 13 is operated, outside air (sample gas) is introduced into the probe 14 through the suction portion 25. The air introduced into the probe 14 passes the filter 15, and thereafter reaches the ion source 4 through the insulation pipe 16. Most part of the air introduced into the ion source 4 is exhausted to the atmosphere through the exhaust port 21 and the pipe 22 by means of the air exhaust pump 13. The pipe 22 is composed of insulating material to insulate the exhaust port 21 from the air exhaust pump 13. In the example of FIG. 1, a Teflon pipe is employed as the pipe 22. The air exhaust pump 13 can maintain the exhaust flow rate constant so that air is introduced into the ion source 4 stably, while the exhaust flow rate can be set desirably. This is necessary because if the flow rate of air introduced into the ion source 4 changes, the number of molecules of drugs to be measured also changes so that a stable measurement cannot be obtained.

In the example of FIG. 1, unlike the conventional technique, molecules of drugs included in the air arriving at the ion source 4 are detected in the form of ions in which protons are added to the molecules of drugs. In this case, it can be considered that the process of ionization of a molecule X of a drug goes along a series of reactions expressed by the following formulae (2-1) to (2-n).

$$H_2O \rightarrow \text{(corona discharge) } H_2O^+ \quad (2\text{-}1)$$

$$H_2O^+ + H_2O \rightarrow H_3O^+ + OH \quad (2\text{-}2)$$

$$H_3O^+ + H_2O \rightarrow (H_2O)_2H^+ \quad (2\text{-}3)$$

$$(H_2O)_{n-1}H^+ + H_2O \rightarrow (H_2O)_nH^+ \quad (2\text{-}(n\text{-}1))$$

$$(H_2O)_nH^+ + X \rightarrow XH^+ + (H_2O)_n \quad (2\text{-}n)$$

where n = 1, 2, 3 . . .

In such a manner, in the first embodiment of the present invention, molecules of water included in the air are first ionized, and thereafter the drug molecule X is ionized by the collision with the ionized water molecules. Therefore, the drug molecule X is ionized in the form of $(M+H)^+$ in which a proton is added to the drug molecule.

Ions of ionized drug molecules are passed through the first small hole electrode 6, the intermediate pressure portion 7 and the second small hole electrode 8 and applied to and condensed by the electrostatic lens 9, then introduced into the mass spectrometric portion 10 as an ion beam. The ion beam is separated in accordance with mass by the mass spectrometric portion 10. The ions separated in accordance with mass are detected by the detector 18, and its detection signal is amplified by the amplifier 19. The detection signal amplified by the amplifier 19 is supplied to the mass determining section 231 of the data processing section 23, so that a mass spectrum can be obtained.

In the mass determining section 231, a signal indicating the obtained mass spectrum is supplied to the drug-A determining section 232, the drug-B determining section 233 and the drug-C determining section 234. Based on the supplied mass spectrum, these determining sections 232 to 234 determine whether any of the drugs A, B and C is detected. If any of the drugs is detected by the determination, a determining signal is supplied to the alarm driving section 235 from corresponding one of the determining sections 232 to 234. The alarm driving section 235 supplies the alarm display section 24 with a signal corresponding to the drug detected based on the supplied determination signal. The alarm display section 24 turns on or turns on and off corresponding one of the display portions 241, 242 and 243 indicating the detected drug, and generates an alarm sound at the same time.

Figure 3:
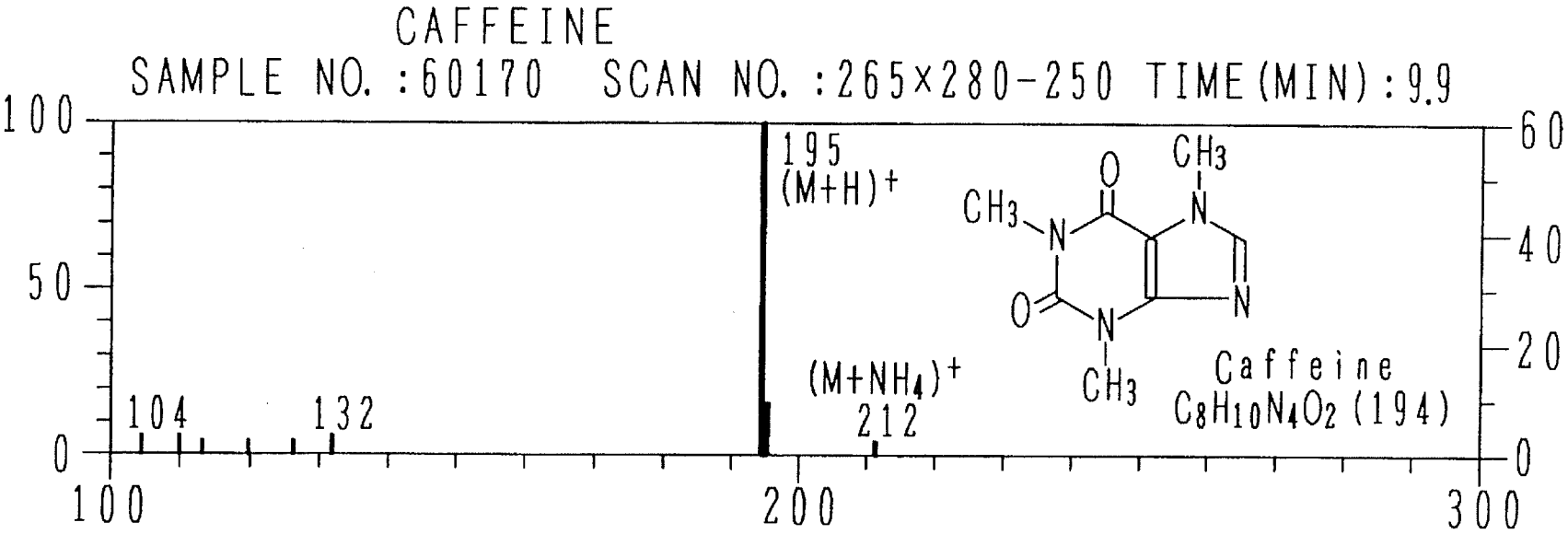
FIG. 3 is a diagram illustrating a measurement result obtained by the first embodiment of the present invention.

FIG. 3 is an example of a mass spectrum obtained by measuring caffeine of alkaloid, which is one of the drugs, with the atmospheric pressure ionization mass spectrometer shown in FIG. 1. In FIG. 3, the height of ion peak not less than 50% is detected in M/Z 195, and the height of ion peak not less than 5% is detected in M/Z 212, although the molecular weight of caffeine is 194. This is because protons are added to caffeine. This is a feature of mass spectrum of caffeine. Therefore, the fact as to whether caffeine is included or not in the sample gas can be determined depending on whether or not such a feature as mentioned above is in the obtained mass spectrum.

Figure 4:
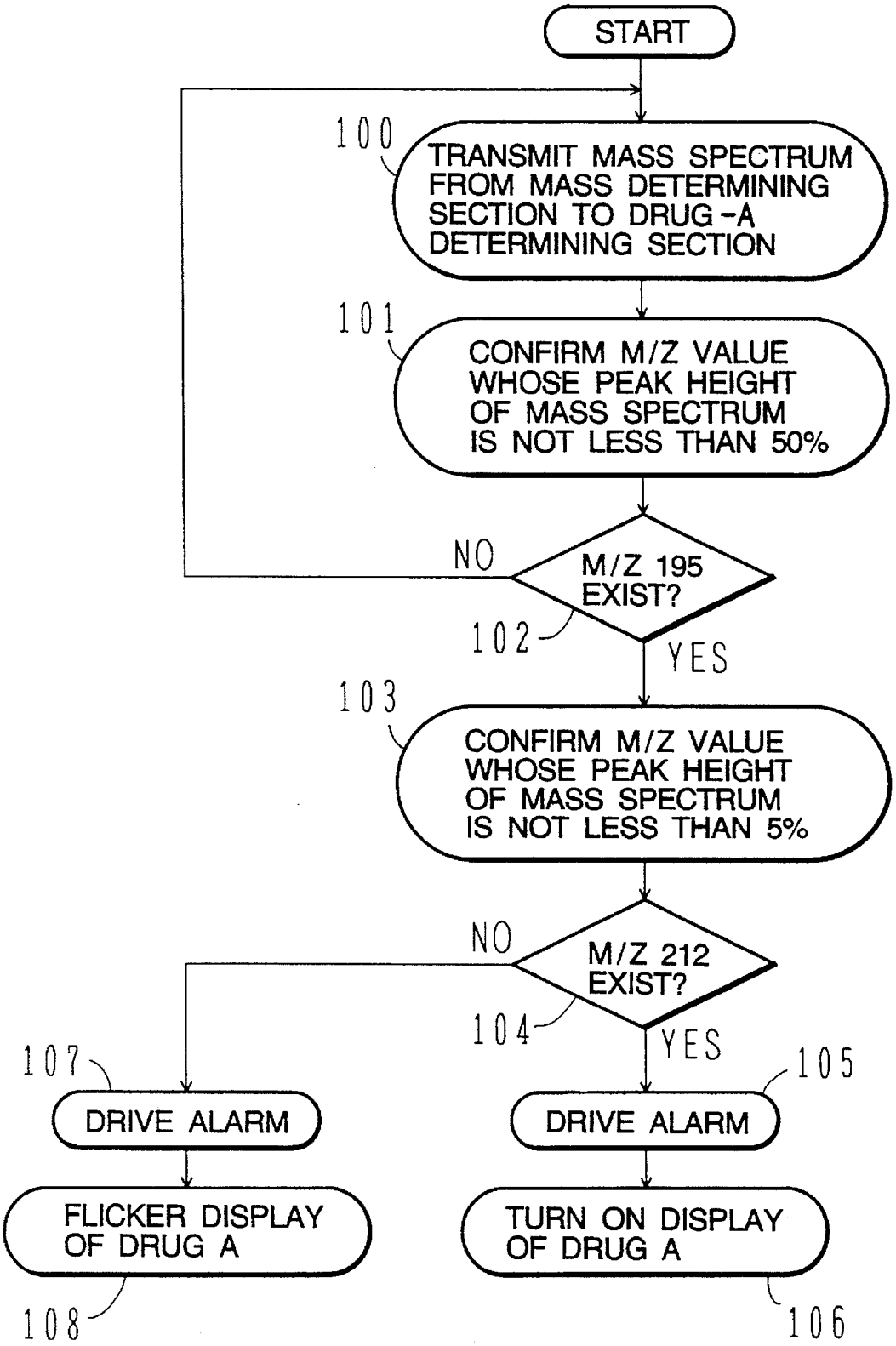
FIG. 4 is a flow chart illustrating a drug determination logic according to the first embodiment of the present invention.

FIG. 4 is a flow chart illustrating a determination logic when the drug-A determining section 232 determines the existence of caffeine.

In Step 100 of FIG. 4, an obtained mass spectrum is transmitted by means of the mass determining section 231 to the drug-A determining section 232. In Step 101, an M/Z value having peak height not less than 50% is confirmed (extracted) from the transmitted mass spectrum. Next, in Sept 102, it is determined whether M/Z 195 exists or not in the M/Z value having peak height not less than 50%. If M/Z 195 does not exist, the process returns to Step 100, and if it exists, the process proceeds to Step 103.

In Step 103, an M/Z value having peak height not less than 5% is confirmed from the mass spectrum. In Step 104, it is determined whether M/Z 212 exists therein or not. If it exists, the process proceeds to Step 105, and an alarm turning-on driving signal is supplied to the alarm driving section 235. Next, the process proceeds to Step 106, and the alarm driving section 235 turns on the display portion 241 of the alarm display section 24 to indicate the existence of caffeine.

If it is determined in Step 104 that M/Z 212 does not exist, the process proceeds to Step 107, and an alarm flicker driving signal is supplied to the alarm driving section 235. Next, the process proceeds to Step 108, and the alarm driving section 235 flickers the display portion 241 to show that there is possibility that caffeine exists in the sample gas.

In such a manner, whether or not a special drug is included in sample gas can be determined by the fact as to whether or not there are a plurality of M/Z values indicating the feature of the special drug.

When a plurality of kinds of drugs are synthesized, its mass spectrum is more complicated than that shown in FIG. 3. It can be considered that the mass spectrum of some kind of drug to be determined has a feature more complicated than that of caffeine (in which an M/Z value 195 exists in the peak height not less than 50% of the mass spectrum, and an M/Z value 212 exists in the peak height not less than 5%). For example, it can be considered that a drug Z has a complicated feature that an M/Z value a exists in the peak not less than 50%, an M/Z value D in the peak not less than 20%, and an M/Z value y in the peak not less than 10%. Also in this case, when the respective drug determining sections 232 to 234 execute such a drug determination logic as mentioned above, whether or not a special drug exists in sample gas can be determined easily in a short time.

As has been described above, according to the first embodiment of the present invention, the probe 14 is movably connected to the ion source 4 through the insulation pipe 16, and sample gas is introduced into the ion source 4 through the probe 14 by means of the air exhaust pump 13. Then, the data processing section 23 determines whether or not a plurality of kinds of M/Z values indicating the feature of a predetermined drug exist in the mass spectrum of the sample gas. As a result, the alarm display section 24 generates an alarm. It is therefore possible to realize an atmospheric pressure ionization mass spectrometer by which impurities included in sample gas such as air or gas stored in a daily storage such as a bag, a package, a pocket or the like, and particularly drugs brought in illegally, can be detected easily and in a short time. In addition, even if several scores of kinds of drugs are synthesized, it is easy and possible to determine whether a predetermined drug exists or not, and to generate an alarm.

Although each of the determining sections 232 to 234 is designed to determine one kind of drug in the above-mentioned embodiment, the present invention may be modified so that one determines two kinds of drugs.

Figure 5:
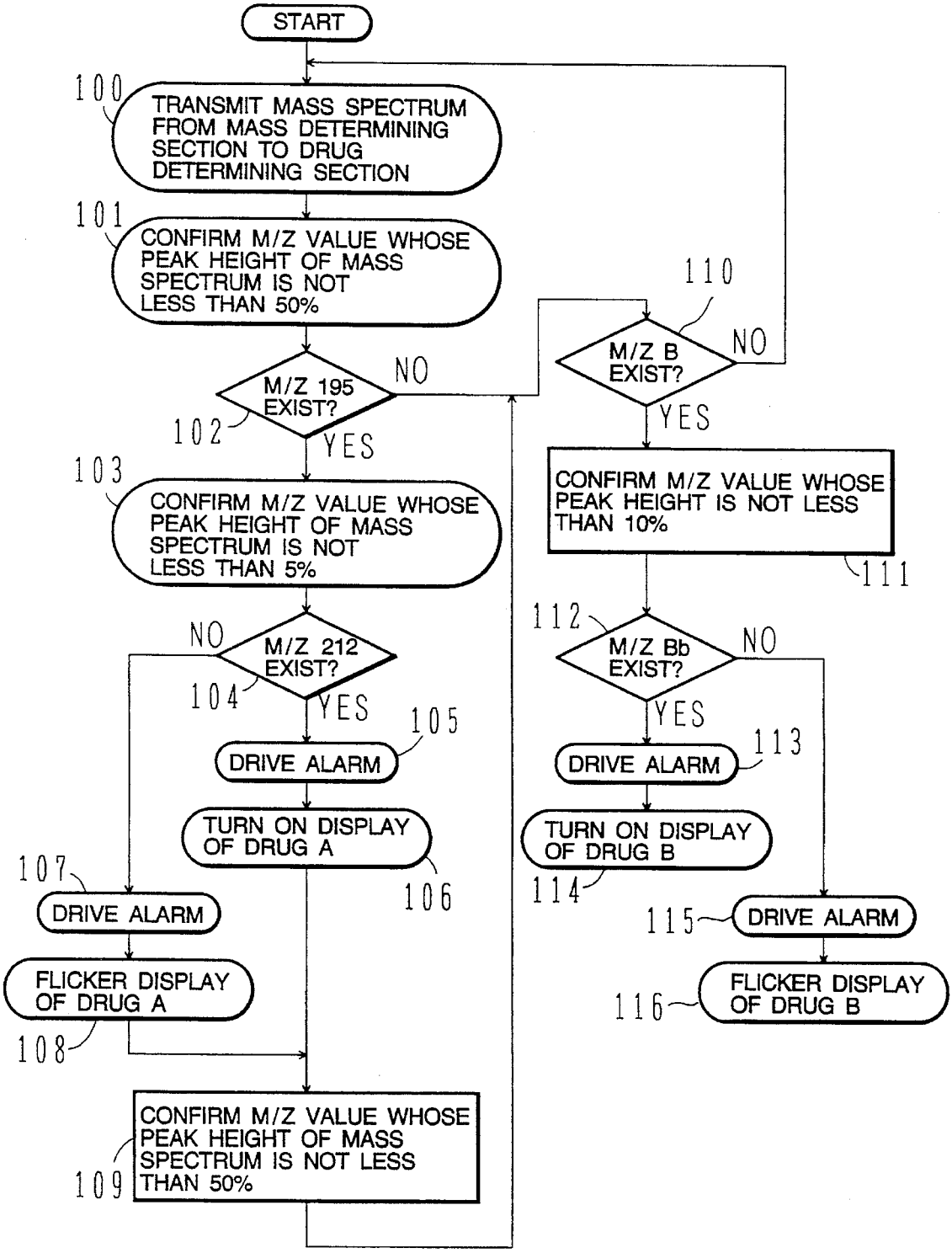
FIG. 5 is a flow chart illustrating a drug determination logic according to a second embodiment of the present invention.
Figure 6:
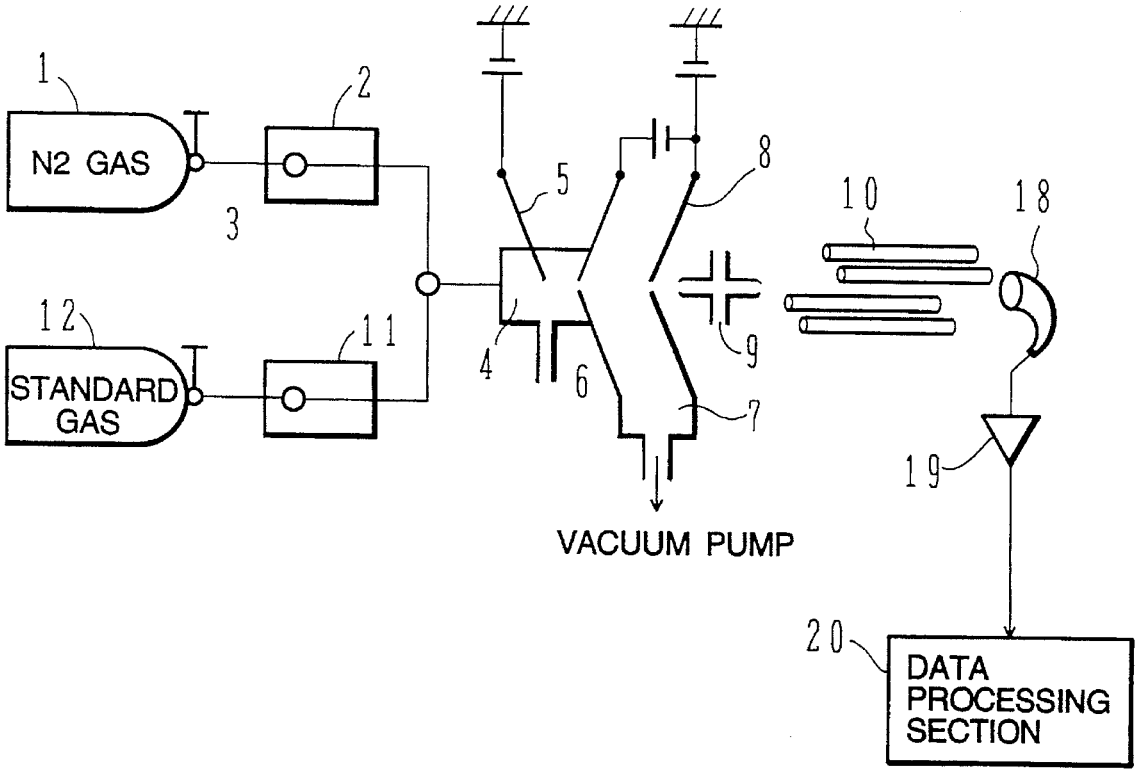
FIG. 6 is a schematic diagram illustrating a conventional atmospheric pressure ionization mass spectrometer.
Figure 7:
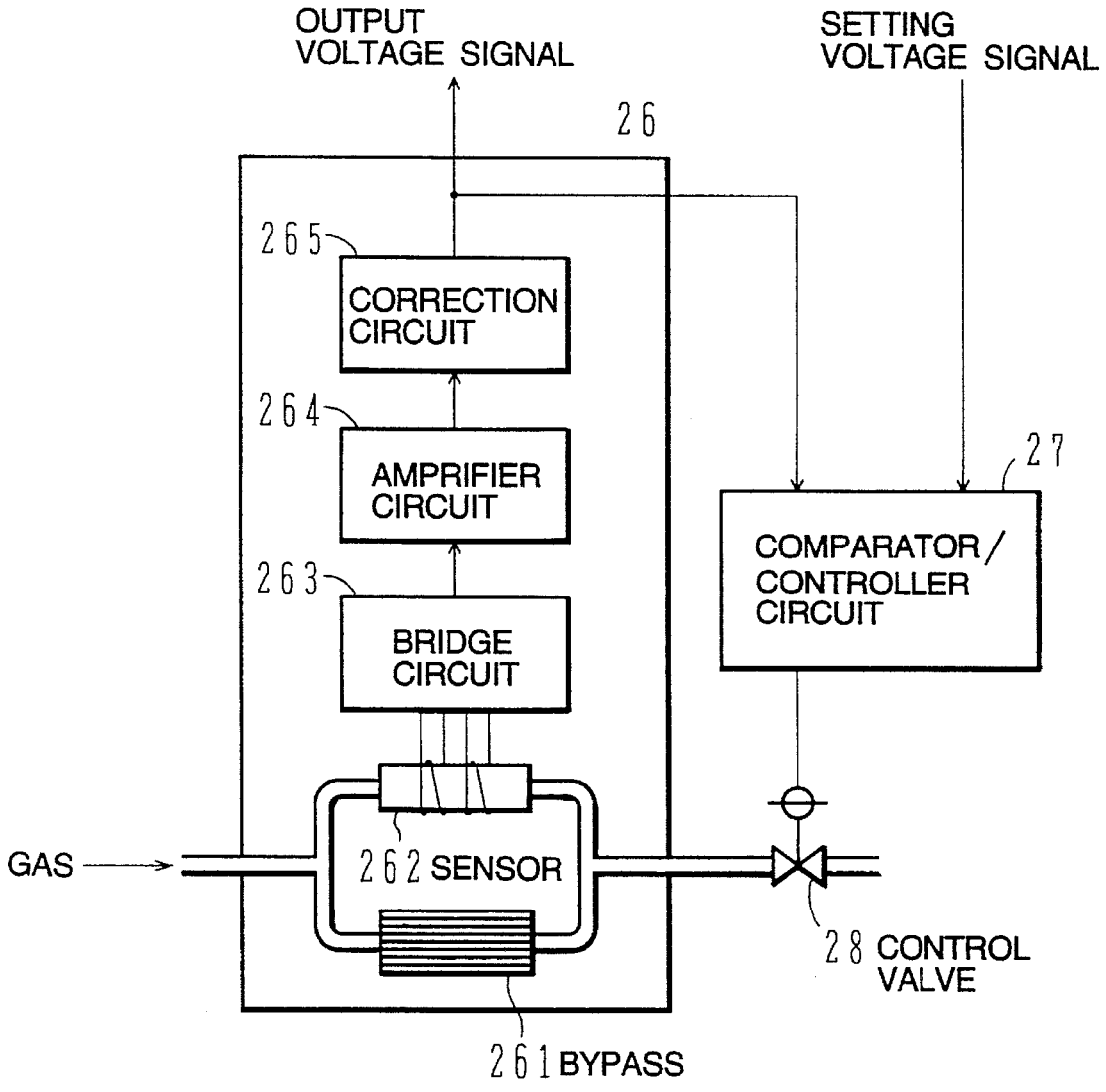
FIG. 7 is a diagram illustrating the structure of a mass flow controller.
Figure 8:
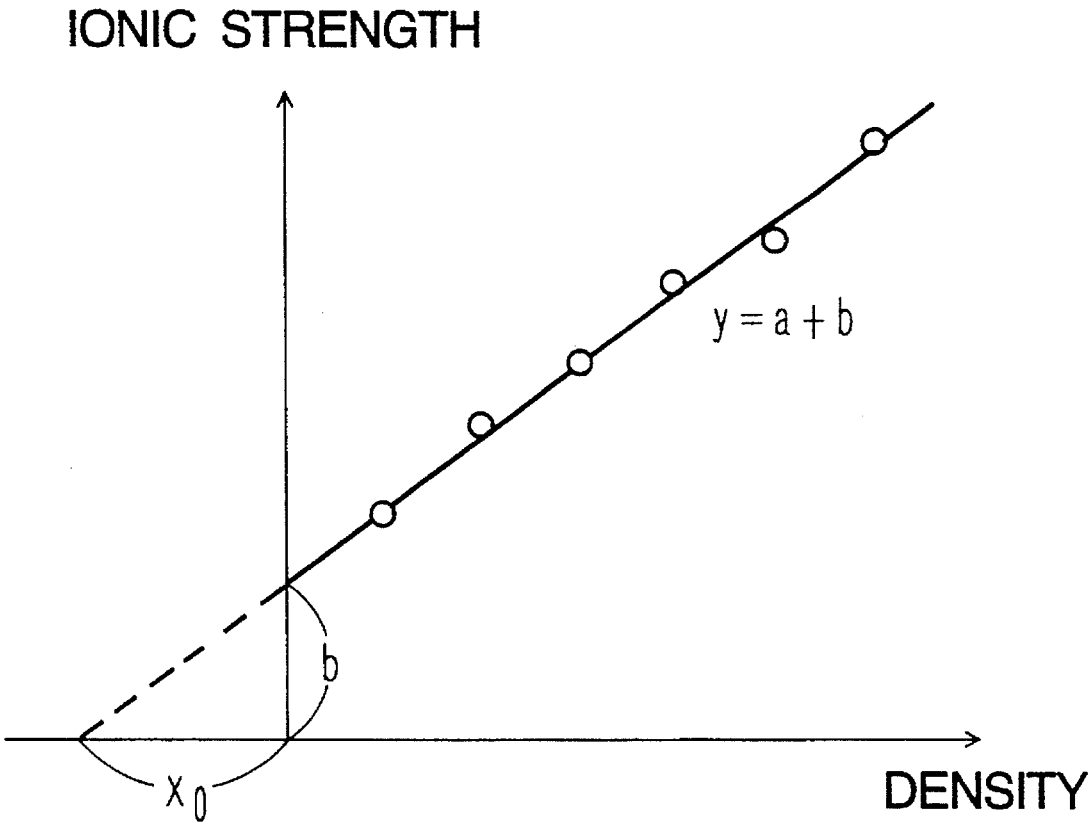
FIG. 8 is a diagram illustrating the principles of an atmospheric pressure ionization mass spectrometer.

FIG. 5 is a flow chart illustrating a determination logic according to a second embodiment of the present invention, in which one determining section determines two kinds of drugs as mentioned above. The whole arrangement thereof is similar to that of FIG. 1 except for the data processing section 23, and therefore its drawing is omitted. In addition, Steps 100 to 108 shown in FIG. 5 are similar to Step 100 to 108 shown in FIG. 4. When an M/Z value 195 does not exist in Step 102, the process proceeds to Step 110. In addition, the process proceeds to Step 109 following Steps 106 and 108.

In Step 109, an M/Z value is confirmed in the peak height of mass spectrum not less than 50%. In Step 110, it is determined whether an M/Z value B exists or not. If it does not exist, the process returns to Step 100. If the M/Z value B exists in Step 110, an M/Z value is confirmed in the peak height of mass spectrum not less than 10% in Step 111. Then the process proceeds to Step 112.

In Step 112, it is determined whether or not an M/Z value Bb exists in the peak height of mass spectrum not less than 10% If the M/Z value Bb exists, an alarm turning-on driving instruction signal is supplied to the alarm driving section 235. Next, in Step 114, the display portion 242 of the alarm display section 24 is turned on so as to indicate the existence of a drug B.

On the other hand, if it is determined in Step 112 that the M/Z value does not exist in the peak height not less than 10%, the process proceeds to Step 115. In this Step 115, an alarm flicker driving instruction signal is supplied to the alarm driving section 235. Next, in Step 116, the display portion 242 of the alarm display section 24 is flickered so as to indicate the possibility of existence of the drug B.

As has been described, also in this second embodiment of the present invention, it is possible to obtain a similar effect to that of the first embodiment.

Although the drug determining sections determine three kinds of drugs A to C in the above-mentioned embodiments, it is possible to design the determining sections to determine three or less kinds or three or more kinds of drugs. For example, it is possible to determine cocaine, morphine and so on other than a stimulant, marihuana, and a narcotic.

The present invention having such a configuration has effects as follows.

In the atmospheric pressure ionization mass spectrometer including an ionization portion which operates under atmospheric pressure or near the atmosphere pressure to ionize sample gas, and a mass spectrometric portion to which ions produced in the ionization portion are supplied through an intermediate pressure region and which analyzes the ions, the mass spectrometer further includes a sample gas suction unit which is movably disposed in a suction port of the ionization portion, and a drug determining portion for determining whether or not a component analyzed by the mass spectrometric portion is a predetermined drug. In this drug determining portion, a plurality of M/Z values indicating a special drug are determined, so that it is determined whether or not the special drug is included in the sample gas. It is therefore possible to realize an atmospheric pressure ionization mass spectrometer by which impurities included in sample gas such as air or gas stored in a daily storage such as a bag, a package, a pocket or the like can be detected continuously and easily. In addition, even if several scores of kinds of drugs are synthesized, it is easy and possible for the drug determining portion to determine whether a predetermined drug exists or not.

What is claimed is:

1. An atmospheric pressure ionization mass spectrometer comprising:

an ionization portion which operates under substantially atmospheric pressure to ionize sample gas;

a mass spectrometer portion to which ions produced in said ionization portion are supplied through an intermediate pressure region and which analyzes said ions;

a sample gas suction device, one end of said sample gas suction device being connected to said ionization portion, the other end of said sample gas suction device being movable relative to said one end of said sample gas suction device;

a data processing section coupled to said mass spectrometric portion and including a drug determining portion; and a pump arranged at a downstream side of said ionization portion, said pump being connected to said ionization portion to introduce said sample gas into said ionization portion through said sample gas suction device.

2. An atmospheric pressure ionization mass spectrometer according to claim 1, wherein said sample gas suction device is connected to a suction port of said ionization portion through a flexible pipe, and wherein a capillary tube is mounted onto a sample gas suction portion of said sample gas suction device.

3. An atmospheric pressure ionization mass spectrometer according to claim 1, wherein an exhaust port is provided in said ionization portion, and an exhaust pump is connected to said exhaust port through a pipe so as to exhaust internal gas in said ionization portion at a predetermined exhaust flow rate.

4. An atmospheric pressure ionization mass spectrometer according to claim 1, wherein said drug determining portion determines whether or not a plurality of M/Z values indicating a predetermined drug exist in a mass'spectrum analyzed and obtained by said mass spectrometric portion to thereby determine whether said predetermined drug is contained or not in the component analyzed by said mass spectrometric portion.

5. An atmospheric pressure ionization mass spectrometer according to claim 2, wherein a filter for removing dusts is mounted on said sample gas suction means, and sample gas sucked by said sample gas suction means is supplied to said ionization portion through said filter.

6. An atmospheric pressure ionization mass spectrometer according to claim 3, wherein the exhaust flow rate of said exhaust means can be desirably set and wherein said exhaust pump can exhaust internal gas in said ionization portion while maintaining said exhaust flow rate setting.

7. An atmospheric pressure ionization mass spectrometer according to claim 2, wherein said pipe is formed of an insulating material.

8. An atmospheric pressure ionization mass spectrometer according to claim 3, wherein said pipe is formed of an insulating material.

9. An atmospheric pressure ionization mass spectrometer according to claim 1, wherein said pump is arranged on the downstream side of said ionization portion; wherein said pump introduces a constant quantity of sample gas into said ionization portion; wherein the sample gas is introduced into the ionization portion from a daily storage container; and wherein said sample gas suction device includes a probe connected to said ionization portion through an insulation pipe.

10. An atmospheric pressure ionization mass spectrometer according to claim 9, wherein said daily storage container is a bag.

11. An atmospheric pressure ionization mass spectrometer according to claim 9, wherein said daily storage container is a package.

12. An atmospheric pressure ionization mass spectrometer according to claim 9, wherein said daily storage container is a pocket.

13. An atmospheric pressure ionization mass spectrometer comprising:

an ionization portion which operates under substantially atmospheric pressure to ionize sample gas;

a mass spectrometric portion to which ions produced in said ionization portion are supplied through an intermediate pressure region and which analyzes said ions;

a probe, one end of said probe being connected to said ionization portion, the other end of said probe being movable relative to said one end of said probe;

a data processing section coupled to said mass spectrometric portion and including a drug determining portion; and a pump arranged at a downstream side of said ionization portion, said pump being connected to said ionization portion to introduce said sample gas into said ionization portion through said probe.

14. A method for performing atmospheric pressure ionization mass spectrometry, comprising:

(a) pumping sample gas at atmospheric pressure into a ionization portion of the mass spectrometer by using a pump arranged at a downstream side of said ionization portion;

(b) ionizing the sampled gas;

(c) mass analyzing the ions; and (d) determining whether predetermined ions are present.

15. The method according to claim 14, further comprising:

(e) filtering sampled gas before ionizing step (b).

16. The method according to claim 14, further comprising:

(e) indicating alarm when step (d) determines that predetermined ions are present.

17. The method according to claim 14, wherein the determining step (d) determines whether predetermined ions from a plurality of drugs are present.

* * * * *

UNITED STATES PATENT AND TRADEMARK OFFICE

CERTIFICATE OF CORRECTION

PATENT NO. : 5,612,534
DATED : March 18, 1997
INVENTOR(S) : Tadao Mimura, et al.

It is certified that error appears in the above-indentified patent and that said Letters Patent is hereby corrected as shown below:

| Column | Line | |
|---|---|---|
| 2 | 16 | Change "(Qs/Qx).Cs" to --(Qs/Qx)·Cs--. |
| 7 | 43 | Change "value a" to --value α--. |
| 7 | 44 | Change "value D" to --value β--. |
| 7 | 45 | Change "value y" to --value γ--. |

Signed and Sealed this

Fifteenth Day of July, 1997

Bruce Lehman

*Attest:*

BRUCE LEHMAN

*Attesting Officer*

*Commissioner of Patents and Trademarks*